US008500120B2

(12) United States Patent
Mandel et al.

(10) Patent No.: US 8,500,120 B2
(45) Date of Patent: Aug. 6, 2013

(54) MEDIA TRANSPORT SYSTEM WITH COORDINATED TRANSFER BETWEEN SECTIONS

(75) Inventors: Barry P. Mandel, Fairport, NY (US); Joannes N. M. deJong, Hopewell Junction, NY (US); Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/218,036

(22) Filed: Aug. 25, 2011

(65) Prior Publication Data

US 2013/0049284 A1 Feb. 28, 2013

(51) Int. Cl.
*B65H 7/02* (2006.01)

(52) U.S. Cl.
CPC ..... *B65H 7/02* (2013.01)
USPC ..... 271/265.02; 399/396

(58) Field of Classification Search
USPC ..... 271/265.02, 275; 399/396
See application file for complete search history.

(56) References Cited

U.S. PATENT DOCUMENTS

| | | | | |
|---|---|---|---|---|
| 7,549,635 | B2 * | 6/2009 | Nakashima | 271/275 |
| 7,673,876 | B1 * | 3/2010 | DeGruchy | 271/264 |
| 7,762,548 | B2 | 7/2010 | Suzuki et al. | |
| 7,793,934 | B2 * | 9/2010 | Matsumoto | 271/265.01 |
| 2001/0055054 | A1 * | 12/2001 | Kosaka et al. | 347/104 |
| 2006/0153607 | A1 * | 7/2006 | Mori | 271/275 |
| 2009/0066018 | A1 * | 3/2009 | Iesaki et al. | 271/264 |
| 2011/0064496 | A1 * | 3/2011 | Ashikawa | 271/265.01 |

* cited by examiner

*Primary Examiner* — Gerald McClain
(74) *Attorney, Agent, or Firm* — Hoffmann & Baron, LLP

(57) ABSTRACT

A media transport apparatus and method includes a first media transport having a first drive unit, configured and operative to convey the substrate media through a marking zone to be marked by a print head. A first motion encoder is operatively connected with the first media transport, configured and operative to output a first signal dependent upon the motion of the first media transport surface. A second media transport with a second drive unit and second motion encoder is configured and operative to receive the substrate media from the first media transport and to convey the substrate media. The second drive unit drives the motion of the second media transport with substantially the same surface velocity as the first media transport. The first and second media transports are each operative to hold the substrate media in contact therewith, with respective first and second hold-down forces that may be different magnitudes, including the first hold down force of the first media transport having a greater magnitude than the second hold down force of the second media transport while the substrate media is at least partially within the marking zone and is subjected to both the first and second hold down forces.

17 Claims, 4 Drawing Sheets

MEDIA TRANSPORT SYSTEM WITH COORDINATED TRANSFER BETWEEN SECTIONS

BACKGROUND

1. Field of the Disclosure

The present disclosure relates to methods of document creation. More specifically, the present disclosure is directed to a system and method for substrate media handling in a marking station providing a high motion quality transfer of the substrate media from the marking zone to downstream handling apparatus.

2. Brief Discussion of Related Art

In direct-marking print applications, particularly those using stationary print heads, high motion quality of the substrate media, free from velocity disturbances or discontinuities, is necessary to achieve high quality image production. However, the transfer of the substrate media from the marking zone transport mechanism to a downstream transport mechanism can introduce disturbances to the motion quality, which can result in unwanted image artifacts on the document.

One potential solution is to introduce an intentional buckle in the substrate media during transport. In this way, any disturbances to motion quality can be absorbed by the buckle, with the flat portion of the substrate media generally undisturbed. Unfortunately, this technique is only applicable with lightweight media types, particularly those which can be buckled without causing permanent damage to the media substrate. This technique is not compatible with heavier and stiffer substrate media, including for example paperboard up to between about 26 and 29 point (i.e., about 0.026-0.029 in. thickness). Therefore, a solution compatible with many types of substrate media is desired.

SUMMARY

In order to overcome these and other weaknesses, drawbacks, and deficiencies in the known art, provided according to the present disclosure is a media transport apparatus for use in a printer having a marking zone with a print head configured and operative to mark a substrate media and form an image thereon. The media transport apparatus includes a first media transport having a first drive unit, configured and operative to convey the substrate media through the marking zone to be marked by the print head. A first motion encoder is operatively connected with the first media transport, configured and operative to output a first signal dependent upon the motion of the first media transport. A second media transport with a second drive unit is configured and operative to receive the substrate media from the first media transport and to convey the substrate media. A second motion encoder is in contact with the second media transport which outputs a second signal dependent upon the motion of the second media transport.

A control unit is configured and operative to receive the first and second signals, and to output a control signal to the second drive unit that is dependent upon a comparison of the first and second signals. The control signal commands the second drive unit to drive the motion of the second media transport with substantially the same surface velocity as the first media transport.

The first and second media transports are each operative to hold the substrate media in contact therewith, with respective first and second hold-down forces. The first hold down force of the first media transport and the second hold down force of the second media transport may be different magnitudes.

Specifically, according to one particular embodiment, the first hold down force of the first media transport has a greater magnitude than the second hold down force of the second media transport while the substrate media is at least partially within the marking zone and is subjected to both the first and second hold down forces. The first and second hold down forces may be generated by an air pressure differential, an electrostatic field, or a combination thereof, and may be variable in a travel direction of the first or second media transports.

Either or both of the first and second motion encoders may be rotary encoders, which rotate in correspondence with the transport velocity of their respective first or second media transports. In one embodiment, each motion encoder is coupled to a wheel of known circumference that is in operative contact with the media transport. The first and second motion encoders may be calibrated relative to one another against a single calibration reference, in one example, one of the first and second media transports.

Also provided according to the present disclosure is a method of substrate media handling in a printer, the method including conveying a substrate media through a marking zone of the printer using a first media transport having a first drive unit, the first media transport having a first motion encoder operatively connected therewith. A first signal is output from the first motion encoder, dependent upon the motion of the first media transport, to a motion controller. The media substrate is passed from the first media transport to a second media transport having a second drive unit to convey the substrate media away from the marking zone. The second media transport has a second motion encoder operatively connected therewith, which outputs a second signal dependent upon the motion of the second media transport. The first and second signals are compared with a control unit, which outputs a control signal that is dependent upon the comparison to the second drive unit, commanding the second drive unit to drive the motion of the second media transport with substantially the same surface velocity as the first media transport.

The substrate media is held to the first and second media transports with respective first and second hold-down forces, which may be of different magnitudes. In particular, the first hold down force of the first media transport may have a greater magnitude than the second hold down force of the second media transport while the substrate media is at least partially within the marking zone and is subjected to both the first and second hold down forces. The first and second hold down forces may be generated by an air pressure differential, an electrostatic field, or a combination thereof. The first or second hold down forces are variable in a travel direction of the first or second media transports, respectively, or with time.

The method further includes calibrating the first and second motion encoders against a single calibration reference. In one embodiment, the calibration reference is one of the first and second media transports.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a sheet of paper, a long web of paper, a ream of paper, etc.), transparencies, parchment, film, fabric, plastic, paperboard up to between about 26 and 29 point (i.e., about 0.026-0.029 in. thickness) or other substrates on which an image can be printed or disposed.

Description

Figure 1:
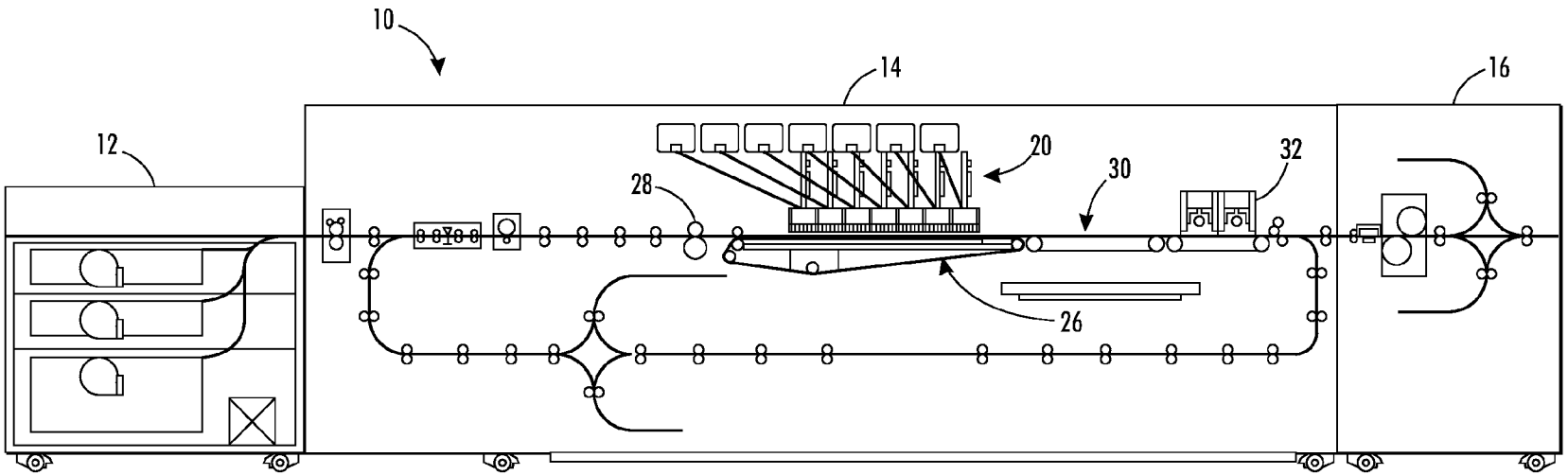
FIG. 1 illustrates a printer according to a first embodiment of the present disclosure.

Referring now to FIG. 1, illustrated is a printer, generally 10, according to a first embodiment of the present disclosure. The printer 10 may include a media feeding unit 12 in which one or more types of substrate media may be stored and from which the substrate media may be fed, for example sheet-by-sheet, to be marked with an image. The media feeding unit 12 delivers substrate media to a marking unit 14. The marking unit delivers marked substrate media to an interface module 16 which may, for example, prepare the substrate for a finishing operation. Optionally the printer 10 may include a finishing unit (not shown), which receives printed documents from the interface module 16. The finishing unit, for example, finishes the documents by stacking, sorting, collating, stapling, hole-punching, or the like.

Figure 2:
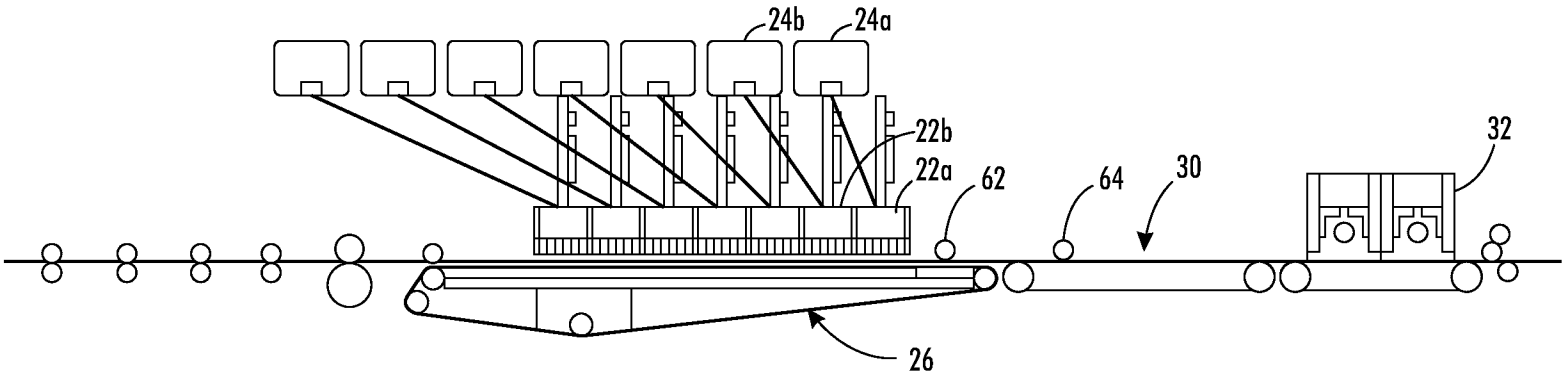
FIG. 2 illustrates a marking zone within the printer.

Referring now to FIG. 2, illustrated in greater detail is the marking zone, generally 20 within the marking unit 14. A marking zone 20 encompasses one or more print heads 22*a*, 22*b*, etc., collectively print heads 22, any of which are operative to directly mark the substrate media and thereby form an image on the substrate media. One technology, as an example only, employable in a print head 22*a* is an ink jet print head configuration. The ink jet print head may draw ink from a reservoir 24*a*, 24*b*, etc. A marking zone transport 26 is operative to hold a substrate media to itself securely, for example by electrostatic means or vacuum means, without limitation. The marking zone transport 26 is further operative to receive a substrate media delivered towards the marking zone 20, for example by roller nips 28, and to convey the substrate media towards, into, through, out of, and/or away from the marking zone 20 with positive control of the motion of the substrate media. The marking zone transport 26 maintains the substrate media within the marking zone 20 in sufficient proximity to the print heads 22*a*, 22*b*, etc., to permit the print heads 22*a*, 22*b*, etc., to mark the substrate media, but prevents the media from contacting the print heads.

The marking zone transport 26 is configured and operative to pass the substrate media to a downstream transport 30 for further handling of the substrate media. For example, the downstream transport 30 in the exemplary embodiment is operative to receive the substrate media from the marking zone transport 26 and to deliver the substrate media to be subjected to a post-marking process. In this example, the post-marking process is ultra-violet light curing under the influence of curing unit 32. It should be appreciated, however, that other marking technologies may require fusing, spreading, drying or some other post marking process instead of ultra-violet light curing, any or all of which may be included without departing from the scope of the instant disclosure.

In the embodiment of the present disclosure described herein, the substrate media transports between which motion is coordinated are both resident within the printing unit 14. However, it will be appreciated by those skilled in the art, in light of the present disclosure, that the disclosure may be implemented to pass substrate media between adjacent transports within or among any of the media feeding unit 12, the marking unit 14, or the handling unit 16, or substantially any other unit in which substrate media is transported, all without departing from the scope of Applicants' present disclosure.

Figure 3:
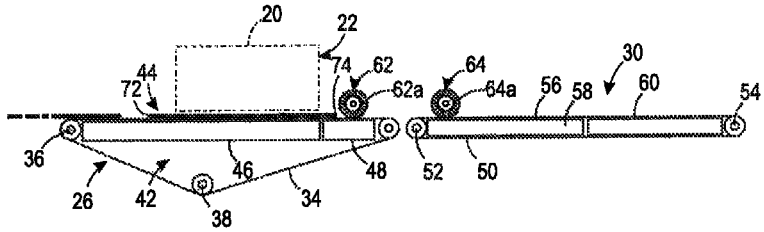
FIG. 3 illustrates schematically the coordination scheme for substrate media passing in the printer.

Referring now to FIG. 3, illustrated schematically is the coordination scheme for substrate media passing between the marking zone transport 26 and the downstream transport 30. Marking zone transport includes an endless belt 34 in a path around idler rollers 36, 40, and driven by a drive roller 38. A marking zone transport drive unit (not shown) controls the motion of the drive roller 38 by command of a motor (not shown) operatively connected with the drive roller 38. The endless belt 34 in one example is air-permeable, and a vacuum hold-down manifold 42 is positioned beneath the endless belt 34 where the endless belt 34 passes beneath the print heads 22, i.e., the endless belt 34 lies at least in part between the vacuum hold-down manifold 42 and the print heads 22. In a known way, the vacuum hold-down manifold 42 introduces a negative atmospheric pressure at its top surface, which in turn draws air through the air-permeable endless belt 34. A unit of substrate media 44 lying on the endless belt 34 is drawn against the endless belt by the airflow which passes through the endless belt 34 and the vacuum hold-down manifold 42.

Further, the vacuum hold-down manifold 42 may be divided, in this case into a leading section 46 and a trailing section 48. More than two divisions may be provided. Leading and trailing are used in the sense of the direction of movement of the substrate media 44 through the marking zone 20, i.e., the substrate media 44 carried on the endless belt 34 of the marking zone transport 26 first encounters the leading section 46 of the vacuum hold-down manifold 42 before next encountering the trailing section 48 of the hold-down manifold 42. The leading and trailing section 46, 48 may also each provide different degrees of negative atmospheric pressure. For example, the trailing section may include a higher degree of negative atmospheric pressure in order to increase and improve the magnitude of the hold-down force obtained by the vacuum hold-down manifold 42 on the substrate media 44, particularly as the substrate media 44 begins to depart the marking zone transport 26 towards the downstream transport 30, i.e., in the downstream direction. The present disclosure also contemplates lateral division (not shown) of the vacuum hold-down manifold 42 with respect to the direction that the substrate media 44 is carried through the marking zone 20 into one or more sections, with or without depicted division into leading and trailing sections 46, 48.

Also illustrated in FIG. 3 is the downstream transport 30. It, too, in the exemplary embodiment, employs an endless belt 50 in a path around a plurality of rollers 52, 54. At least one roller, e.g., 54 of the downstream transport 30 is a drive roller, with others of the rollers, e.g., 52, being an idler(s). A downstream transport drive unit (not shown) controls the motion of the drive roller 54 by command of a motor attached thereto. In the present embodiment, the endless belt 50 is an air-permeable endless belt, and the downstream transport 30 is provided with a vacuum hold-down manifold 56 beneath a portion of the endless belt 50. As example only, the vacuum hold-down manifold 56 is further divided into leading section 58 and trailing section 60, any may optionally include lateral division.

Furthermore, it will be appreciated that alternate hold-down means, for example an electrostatic hold-down mechanism as known in the art, may be combined with the marking zone transport 26 and/or downstream transport 30 in addition to or in place of the vacuum hold-down manifolds 42, 56 without departing from the scope of the present disclosure.

In one embodiment of the present disclosure, the motion of both endless belts 34, 50 are monitored by one or more motion encoders, in this case rotary encoders 62, 64. The rotary encoders 62, 64 are preferably coupled to wheels of known circumference having a non-skid surface 62*a*, 64*a*, respectively, on at least a portion of the circumference thereof. Non-skid surfaces 62*a*, 64*a* increases the precision and accuracy of the correspondence between linear motion of the endless belts 34, 50 and rotary motion of the rotary encoders 62, 64 when the latter are in contact with the former. The rotary encoders 62, 64 are preferably mounted to track the motion of the endless belts 34, 50 only, and to not contact the substrate media 44.

Figure 4:
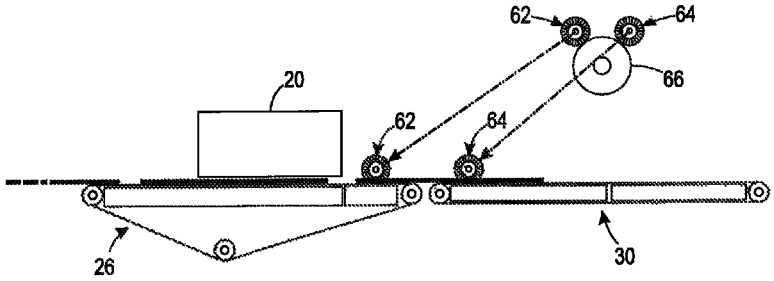
FIG. 4 illustrates a first encoder calibration scheme according to the present disclosure.
Figure 5:
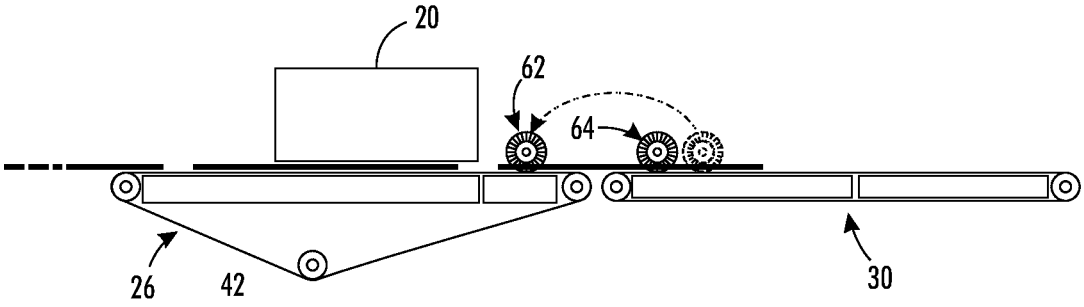
FIG. 5 illustrates a second encoder calibration scheme according to the present disclosure.

Further, where plural rotary encoders 62, 64 are used, i.e., to separately track to motion of the endless belts 34, 50, these are preferably calibrated with respect to one another to promote the accuracy of transfer between the marking zone transport 26 and the downstream transport 30. Referring now to FIG. 4, illustrated is one calibration scheme. In this scheme the rotary encoders 62, 64 are calibrated in advance of their installation on the printer 10 with reference to a single and known calibration wheel 66. In another calibration scheme, illustrated in FIG. 5, the rotary encoders 62, 64 are calibrated by first running the two rotary encoders 62, 64 on the same endless belt, in this case endless belt 50 of the downstream transport 30. Then one of the two rotary encoders, in this case, rotary encoder 62, is relocated into contact with the endless belt 34 of the marking zone transport 26.

Figure 6:
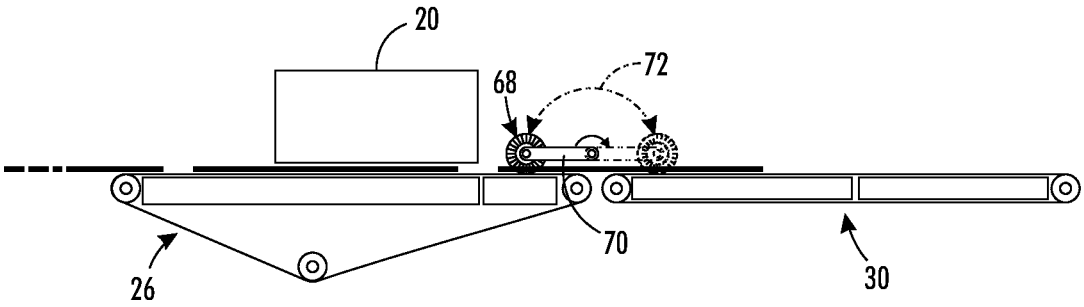
FIG. 6 illustrates an alternate embodiment for monitoring media transport movement according to an embodiment of the present disclosure.

A third scheme is illustrated in FIG. 6. In the case of FIG. 6, only a single rotary encoder 68 is used. An actuator 70, in this case, but not necessarily, is a rotary actuator operable to articulate the rotary encoder 68 between first and second positions as indicated by arrow 72, alternately in contact with the endless belt 34 of the marking zone transport 26 and endless belt 50 of the downstream transport 30, respectively. The actuator 70 is also operative to provide feedback to a motion controller (not shown) concerning its position, for example by one or more limit switches or the like. This positional feedback of the actuator 70 permits the motion controller to properly interpret the output of the rotary encoder 68. In the arrangement depicted in FIG. 6, only a single rotary encoder 68 is required, and there is no need for a preliminary calibration to verify agreement between plural rotary encoders, e.g. 62, 64. However, this configuration precludes the simultaneous monitoring of the motion of both the marking zone transport 24 and the downstream transport 30, and requires feedback concerning the position of the actuator 70 to permit a proper interpretation of the rotary encoder 68 information.

According to the present disclosure, a motion controller (not shown) receives the position signals from both rotary encoders 62, 64, or from rotary encoder 68 together with positional feedback of the actuator 70. The motion controller then commands the respective drive units associated with the drive rollers 38, 54 of the respective marking zone transport 26 and downstream transport 30 to maintain with substantially the same surface velocity between the endless belts 34, 50. Motion detection and feedback through rotary encoders 62, 64 and/or 68 ensure motion quality and coordination in the handoff between the two substrate media transports 26, 30. In particular, the downstream transport 30 is "slaved" or made to precisely follow the detected motion of the marking zone transport.

Further, it is contemplated by the present disclosure that the marking zone transport entirely control the motion of the substrate media 44 until the trailing edge 72 of the substrate media 44 has left the marking zone 20, even though as a practical matter a leading edge 74 of the substrate media 44 will have engaged with the downstream transport while the trailing edge 72 remains within the marking zone 20. In furtherance of this operation, the downstream transport 30 may be operated to have a reduced hold-down force than the marking zone transport 26, in whole or in part. Providing the marking zone transport 26 with greater degree of hold-down force ensures that if any mismatch in motion between the marking zone transport 26 and the downstream transport 30 occurs, the marking zone transport 26 will control the motion of the substrate media 44 at all times while the substrate media 44 is within the marking zone 20 and/or being printed upon by print heads 22. This promotes a high-quality image that is not distorted by motion quality errors in the handling of the substrate media 44.

In certain embodiments, it may be beneficial to induce gradients in hold-down force along the direction of substrate travel within a transport. Most basically, the marking zone transport 26 may provide a greater degree of overall hold down force as compared to the downstream transport 30. In a further refinement, the trailing section 48 of the marking zone hold down manifold 42 may be provided with an increased hold-down force as compared to leading section 46, the downstream manifold 56 generally, or some section thereof, e.g., 58, 60. Therefore, while the substrate media 44, and particularly leading edge 74, leaves the marking zone 20, and presents less area to the marking zone transport 26 which effectively ends in the downstream direction at idler roller 40, the increased hold-down force of the trailing section 48 of the hold down manifold 42 aids the marking zone transport 26 in maintaining control of the substrate media 44 while the trailing edge 72 remains within the marking zone 20.

Conversely, the downstream transport 30, or at least a portion thereof, may present a reduced hold-down force to the substrate media 44. In this way, the control of the substrate media by the marking zone transport 26 is assured. By way of example, the division of the hold-down manifold 56 of the downstream transport 30 into leading section 58 and trailing section 60 may be arranged such that the substrate media 44 encounters only the leading section 58 of the hold down manifold 56 until the trailing edge 72 leaves the marking zone 20. Accordingly, only the leading section 58 need present any reduction in hold-down force to yield to the marking zone transport 26. A more normal or even compensatory hold-down force may be supplied by the trailing section 60, adequate to ensure downstream motion quality away from the marking zone.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A media transport apparatus for use in a printer having a marking zone with a print head configured and operative to mark a substrate media and form an image thereon, the media transport apparatus comprising:

a first media transport having a first endless belt including a first transport surface, and a first drive unit, the first endless belt traversing the marking zone to convey the substrate media through the marking zone to be marked by the print head;

a first motion encoder operatively connected with the first transport surface, the first motion encoder configured and operative to output a first signal dependent upon the motion of the first transport surface;

a second media transport having a second transport surface and a second drive unit, the second media transport configured and operative to receive the substrate media from the first media transport and to convey the substrate media;

a second motion encoder operatively connected with the second transport surface which outputs a second signal dependent upon the motion of the second transport surface; and a control unit configured and operative to receive the first and second signals, and to output a control signal to the second drive unit that is dependent upon a comparison of the first and second signals, the control signal commanding the second drive unit to drive the motion of the second media transport with substantially the same surface velocity as the first media transport, wherein the first and second media transports are each operative to hold the substrate media in contact therewith, with respective first and second hold-down forces of different first and second respective magnitudes.

2. The apparatus according to claim 1, wherein the first media transport is operative to hold the substrate media in contact with the first transport surface along at least a length of the first endless belt.

3. The apparatus according to claim 1, wherein the second media transport includes a second endless belt having the second transport surface, the second media transport configured and operative to hold the substrate media in contact with the second transport surface along at least a length of the second endless belt.

4. The apparatus according to claim 1, wherein the first hold down force of the first media transport has a greater magnitude than the second hold down force of the second media transport while the substrate media is at least partially within the marking zone and is subjected to both the first and second hold down forces.

5. The apparatus according to claim 1, wherein the first and second hold down forces are generated by an air pressure differential, an electrostatic field, or a combination thereof.

6. The apparatus according to claim 1, wherein the first or second hold down forces vary in a travel direction of the first or second media transports, respectively.

7. The apparatus according to claim 1, wherein either or both of the first and second motion encoders are rotary encoders which rotate in correspondence with motion of their respective first or second transport surfaces.

8. The apparatus according to claim 1, wherein the first and second motion encoders are calibrated against a single calibration reference.

9. The apparatus according to claim 1, wherein at least one of the first motion encoder and the second motion encoder is in contact with the respective first transport surface or second transport surface.

10. A method of substrate media handling, comprising:

conveying a substrate media through a marking zone of the printer using a first media transport having a first endless bell including a first media transport surface, the first endless belt traversing the marking zone, a first drive unit, and a first motion encoder operatively connected with the first media transport surface;

outputting a first signal from the first motion encoder to a motion controller, the first signal dependent upon the motion of the first media transport surface;

passing the substrate media from the first media transport to a second media transport having a second media transport surface, a second drive unit, and a second motion encoder operatively connected with the second media transport surface, to convey the substrate media away from the marking zone;

outputting a second signal from the second motion encoder, the second signal dependent upon the motion of the second media transport surface;

comparing the first and second signals with a control unit;

outputting a control signal that is dependent upon the comparison of the first and second signals from the control, unit to the second drive unit, the control signal commanding the second drive unit to drive the motion of the second media transport with substantially the same surface velocity as the first media transport; and holding the substrate media to the first and second media transports with respective first and second hold-down forces, wherein the first hold down three of the first media transport and the second hold down force of the second media transport are of different first and second respective magnitudes.

11. The method according to claim 10, further comprising holding the substrate media in contact with the first transport surface along at least a length of the first endless belt.

12. The method according to claim 10, wherein the second media transport includes a second endless belt having the second transport surface, the method further comprising holding the substrate media in contact with the second transport surface along at least a length of the second endless belt.

13. The method of substrate media handling according to claim 10, wherein the first hold down force of the first media transport has a greater magnitude than the second hold down force of the second media transport while the substrate media is at least partially within the marking zone and is subjected to both the first and second hold down forces.

14. The method of substrate media handling according to claim 10, wherein the first and second hold down forces are generated by an air pressure differential, an electrostatic field, or a combination thereof.

15. The method of substrate media handling according to claim 10, wherein the first or second hold down forces vary in a travel direction of the first or second media transports, respectively.

16. The method of substrate media handling according to claim 10, further comprising calibrating the first and second motion encoders against a single calibration reference.

17. The method according to claim 10, wherein at least one of the first motion encoder and the second motion encoder is in contact with the respective first transport surface or second transport surface.

* * * * *